United States Patent [19]

Godat et al.

[11] 4,380,399

[45] Apr. 19, 1983

[54] MIXER FOR HOMOGENIZING A MIXTURE OF PRODUCTS CONTAINED IN A VESSEL

[75] Inventors: Jean Godat, Olivet; Daniel Parmenon, Orleans la Source; Alain Krzywdziak, Saint Denis en Val; Daniel Boudin, Orleans, all of France

[73] Assignee: Fonderie et Ateliers des Sablons, Orleans, France

[21] Appl. No.: 221,717

[22] Filed: Dec. 31, 1980

[30] Foreign Application Priority Data

Jan. 7, 1980 [FR] France ..... 80 00199
Dec. 9, 1980 [FR] France ..... 80 26095

[51] Int. Cl.[3] ..... B01F 7/24

[52] U.S. Cl. ..... 366/289; 366/309; 366/605; 366/320

[58] Field of Search ..... 366/108, 116, 117, 118, 366/119, 120, 122, 125, 242, 244, 245, 249, 255, 366/260, 279, 280, 281, 282, 289, 309, 310, 311, 312, 366/313, 318, 320, 605; 99/348

[56] References Cited

U.S. PATENT DOCUMENTS

| | | | |
|---|---|---|---|
| 2,047,318 | 7/1936 | Esslen | 366/312 |
| 2,513,254 | 6/1950 | Savage et al. | 99/348 X |
| 2,701,131 | 2/1955 | Love | 366/289 X |
| 2,898,094 | 8/1959 | O'Neill, Jr. | 366/289 X |
| 3,132,849 | 5/1964 | Kritikson | 366/312 X |

FOREIGN PATENT DOCUMENTS

| | | | |
|---|---|---|---|
| 412378 | 12/1945 | Italy | 366/260 |
| 1322955 | 7/1973 | United Kingdom | 99/348 |

*Primary Examiner*—Philip R. Coe
*Assistant Examiner*—Joseph M. Pitko
*Attorney, Agent, or Firm*—Scully, Scott, Murphy & Presser

[57] ABSTRACT

A mixer for use in combination with a vessel having a detachable lid is provided which comprises a helical blade rotatably mounted upon a vertical shaft pivoting at its upper end within a bearing member disposed within the lid of said vessel, said helical blade providing a vertical mixing, and means for imparting a vibratory motion of low vertical amplitude to said blade, said vibratory movement being generated from the rotating motion of the mixer shaft.

8 Claims, 11 Drawing Figures

MIXER FOR HOMOGENIZING A MIXTURE OF PRODUCTS CONTAINED IN A VESSEL

BACKGROUND OF THE INVENTION

1. Field of the Invention

The present invention relates to a mixer for homogenizing a mixture of products at least one of which is present in the liquid phase.

2. Description of the Prior Art

The mixer herein is especially, but not exclusively, adapted for use in the preparation of paints for motor vehicles. For such application, the mixer is basically intended to be used for the resuspension and storage of base paints used on automobile bodies, corresponding to the various vehicles in manufacture.

In practice, it is essential that these base paints be perfectly homogeneous in order that the quantities set aside in accordance with the preparative formulas correspond to perfectly uniform pigment quantities, an essential condition for assuring faithful color reproduction.

Usually, the mixer is driven in rotation by a mechanical device whose shaft passes through a lid integrally fixed upon the base paint container.

It is known at the present time that there exists on the market several types of mixers of this kind, of which the most common essentially comprise:

- either a sheet-metal flap furnished with shutters which rotates about the rotating shaft while forming a vertical plane moving in the liquid, a part of the paint passing through shutters and resulting in a certain degree of mixing;
- or a lower helical primary blade but with a very steep pitch, and a secondary, flat, blade situated near the surface of the liquid, this mixer causing during its rotation, a mixing of a different nature from that of the previously described type, which produces a vertical convection movement;
- or else a helical blade whose pitch is shallower than in the preceding case, and which provides similarly effective mixing with, however, a vortex capable of creating an air-paint and emulsion mixture being formed at the center of the device.

These three types of mixers are commonly used without it having been possible to clearly demonstrate an incontestable superiority of one compared to the others, principally during laboratory tests and under conditions simulating the viscosity of the paint.

On the other hand, these mixers present a serious drawback during the mixing of base paints in which there is considerable settling of suspended material, for example, in the case of metallized bases in which there exists a deposit of several centimeters of concentrated aluminum powder. In practice, none of these mixers have shown themselves to be sufficiently effective, the operator being forced to carry out manual mixing before working with the mixing machine.

SUMMARY OF THE INVENTION

The present invention has, therefore, for its purpose to eliminate the foregoing drawbacks. In accordance with the invention, a mixer is provided which provides superior mixing effectiveness compared to that of the three previously described types of mixers and which is suitable for high settling conditions.

To achieve these objects, the mixer of this invention comprises a helical blade rotatably mounted upon a vertical shaft pivoting at its upper end within a bearing member disposed within the detachable lid of said vessel so as to provide mixing in the vertical direction and means for imparting a vibratory movement of low vertical amplitude to said blade, this vibratory motion being generated from the rotating motion of the shaft of the mixer.

Furthermore, in this mixer, the helical blade comprises at its base a scraping device made up of a spring, or round wire, exercising a uniform pressure on the bottom and side of the vessel containing the mixture to be mixed, this spring being capable, if desired, of contributing to the production of said vibratory motion. According to one embodiment of the invention, said scraping device is independent of the means providing the vibratory motion of the helical blade. In this case, the scraping device can advantageously take the form of a pin or similar means radially mounted on the lower edge of the helical blade so as to be able to radially slide and pivot in relation to the latter. This pin comprises, moreover, an inclined element for receiving during its rotation, a hydrodynamic pressure F caused by the viscosity of the mixture to be homogenized, whose radial component in relation to the mixer's axis of rotation F2 tends to make the pin slide against the lateral wall of the vessel causing a reaction $R_1$ and a scraping action of the deposit on said wall, and whose axial component F1 in relation to said axis causes a rotational moment M and a reaction $R_2$ upon the bottom of the vessel providing the scraping thereof.

Thus, the combined action of these two forces causes an excellent scraping of the bottom and lateral wall of the vessel where the deposit is found and, as it is easy to obtain a right angle deflection of this pin, contact on the wall and bottom is excellent.

BRIEF DESCRIPTION OF THE DRAWINGS

One embodiment of the invention will be described hereafter, by way of a non-limiting example, by reference to the attached drawings in which.

DESCRIPTION OF THE PREFERRED EMBODIMENTS

Figures 1, 5:
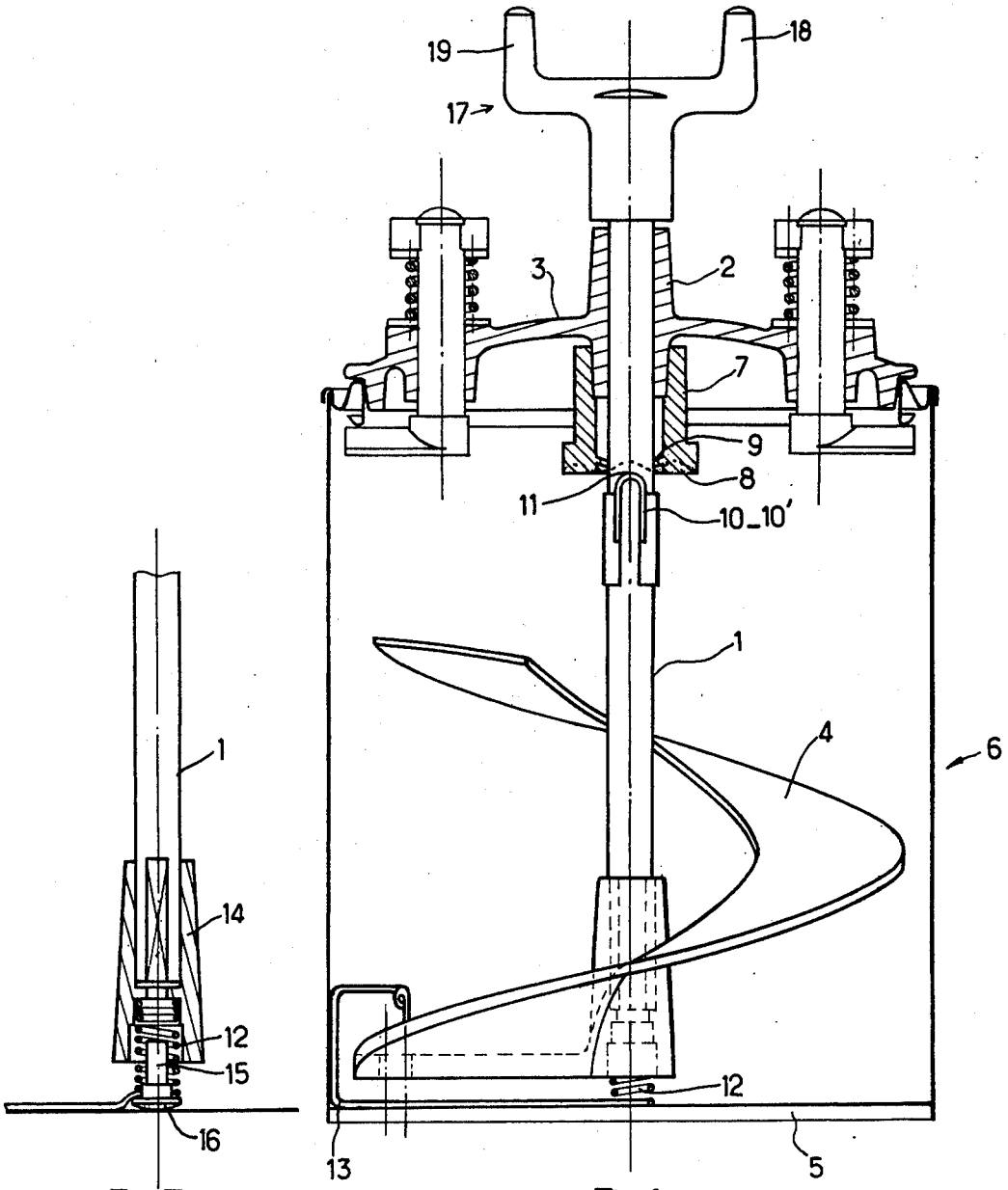
FIGS. 1 and 2 are two axial sections of a mixer mounted on a lid usable on a conventional mixing machine.
FIG. 5 is an axial section of the base of a mixer provided with a support center-point.
Figure 2:
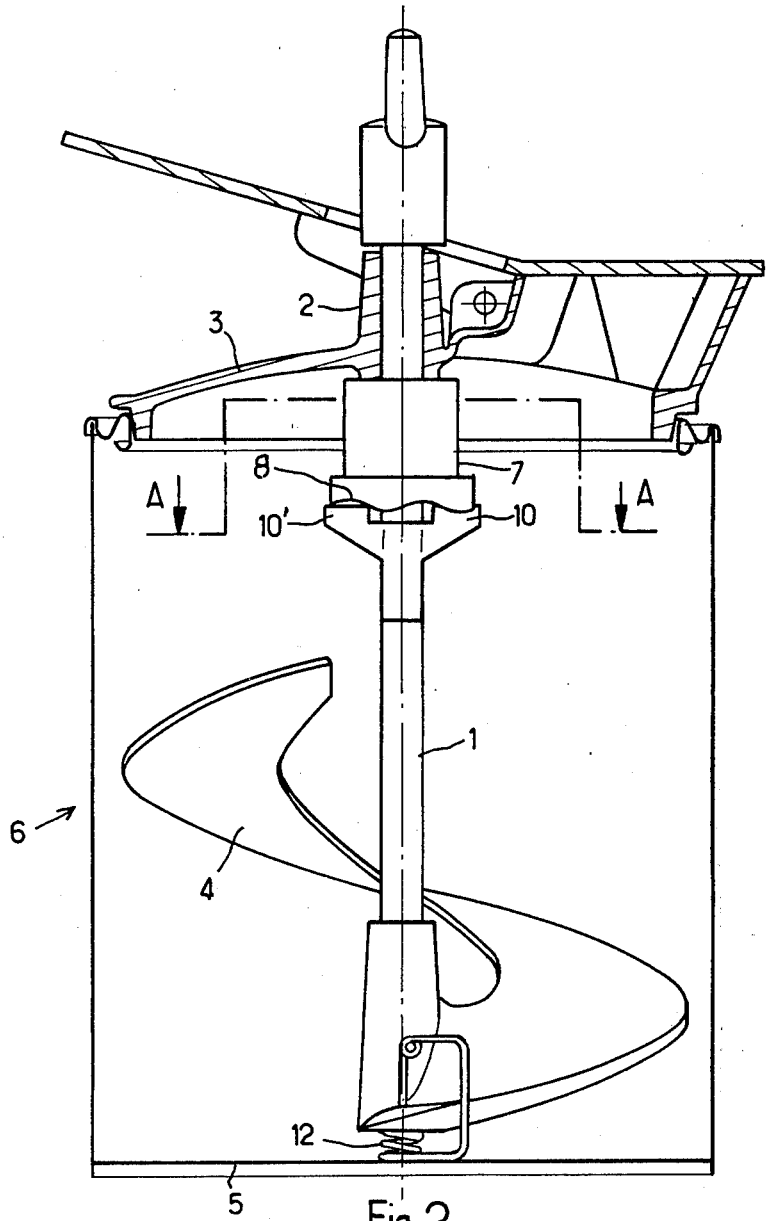
Figure 3:
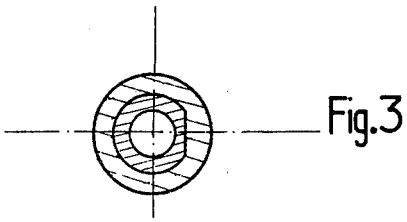
FIG. 3 is a cross-section according to line A—A of FIG. 2.
Figure 4:
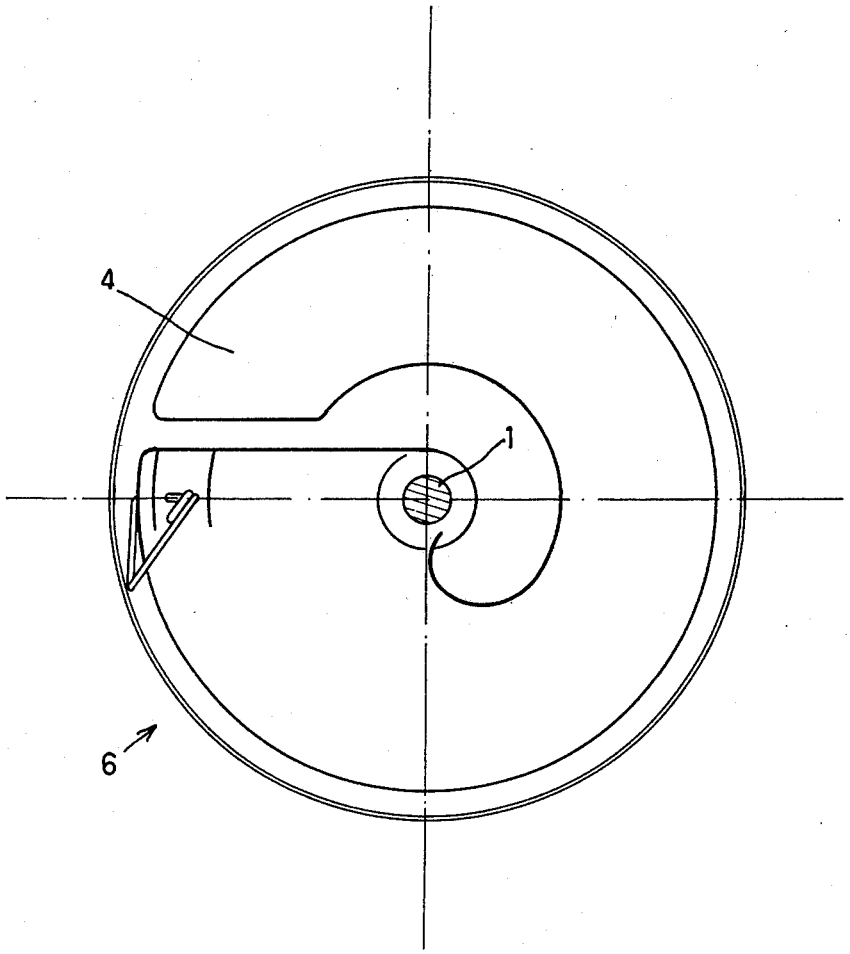
FIG. 4 is a plan view of the mixer illustrated in FIGS. 1 and 2.

As represented in these drawings, the mixer of this invention comprises, first of all, a vertical shaft 1 pivotally mounted at its upper end in a bearing member 2 made of the same material as moulded lid 3 of the type which is usually employed by mixing machines for car paints. At the lower end of shaft 1 is fixed a helical ramp 4 whose pitch has been experimentally designed to produce the most effective mixing possible without introducing air during the mixing operation.

Since the mixer generally turns clockwise, a helix having a right-handed spiral is employed, so that it tends to turn into settled material and quickly reach the bottom 5 of vessel 6.

The width of ramp 4 is determined in such a way that there exists a sufficient volume around shaft 1 in order that the paint which is quickly carried to the upper part can re-descend through the center and then start its movement over again indefinitely.

By contrast, at the base of the mixer, helical ramp 4 is extended up the shaft in order that no untouched zone may exist at the bottom of the vessel.

It became evident during use of the device that when paints having high sediment levels were to be homogenized with the use of previously described ramp 4, the latter became loaded with a deposit which could not be dissolved.

To eliminate this drawback, the invention has therefore made provision for a device making it possible to produce on shaft 1 and, consequently, on ramp 4, vertical impulses of low amplitude and determined frequency which will succeed in breaking up the deposit and facilitate its sliding on the blade until it is dispersed in the solvent medium.

Stated more precisely, this device employs a tubular coupling sleeve 7 mounted within bearing member 2 of lid 3 and whose lower lip forms a notched crown 8 presenting a sinusoidal appearance. Coupling sleeve 7 can be fabricated, for example, as a piece of specially molded plastic material having high wear and solvent resistance. The sleeve can, moreover, comprise a circular flexible lip 9 for achieving a fluid-tight fit around shaft 1.

In this notched crown 8, two diametrically opposed stops 10 and 10′ integral with shaft 1 come to bear. These stops 10 and 10′ can be advantageously formed from a stainless steel sheet bent in the form of a U whose cylindrical part 11 contacts notched crown 8.

Contact between stops 10 and 10′ and notched crown 8 is maintained by means of compression-spring 12 mounted at the lower end of shaft 1, and which comes to bear on bottom 5 of vessel 6 upon which lid 3 is mounted.

Thus, during rotation of shaft 1, passage of stops 10 and 10′ on a tooth of notched crown 8 causes a downward movement of shaft 1 against the action of spring 12. The spring provides the reverse movement of the shaft in the upward direction when stops 10 and 10′ enter a vacant section of notched crown 8.

In this manner there is obtained, at a level with the helical ramp, superposition of two actions (convection-vibration) which individually cannot produce rapid homogenization.

However, it has been observed experimentally that even with these two actions, a deposit of sediment of a certain thickness was produced on the bottom 5 and lateral walls of vessel 6 at the place where decantation was brought about. Accordingly, in order to resuspend this deposit, the mixer herein is provided with a helical spring 12 whose lower uncoiled end extends against bottom 5 and, because of a rightangle deflection 13, against the lateral wall of vessel 6, before coming back towards helical ramp 4 to which it is attached.

This assembly makes it possible at the same time to exercise on shaft 1 the necessary axial force to obtain the vibratory action and to insure a scraping of the bottom 5 and the lateral wall of vessel 6 to a portion of its depth.

In the embodiment shown in FIG. 5, the helical blade of the mixer is attached to a tubular coupling sleeve 14 mounted at the end of shaft 1. In the lower part of this coupling sleeve is fitted the upper spiral part of a spring and, coaxially to this spring, the shank of a supporting center-point 15 whose head 16, preferably of circular configuration, is designed to abut against bottom 5 of vessel 6.

It will be noted, finally, that in the previously described examples rotational movement of the shaft is provided by a rapid coupling device connected to a driving unit (not shown) such as an electric motor. This coupling device is provided as a fork 17 in the form of a U which cooperates with a rotary blade of the driving unit. In the coupled position, the axes of the mixer and the axis of the driving unit are coaxial and the blade is engaged between the two arms 18 and 19 of fork 17. Such a coupling has the advantage of allowing axial play in the mixer's shaft in relation to the driving shaft.

Figure 6:
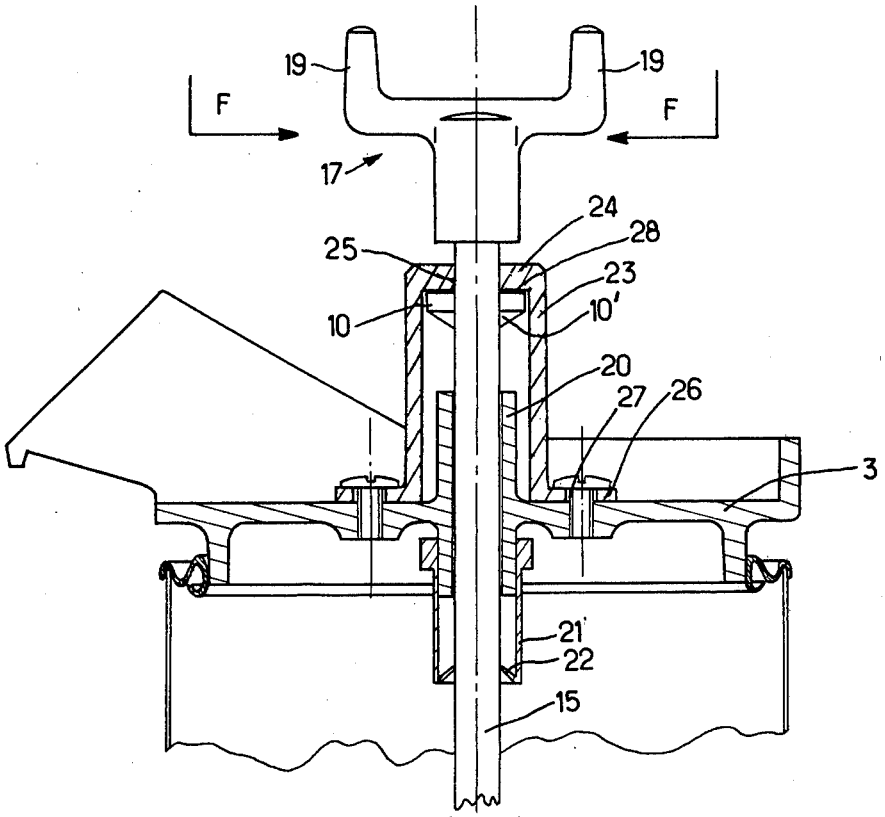
FIG. 6 is a partial axial section of a mixer according to another embodiment of the invention.
Figure 7:
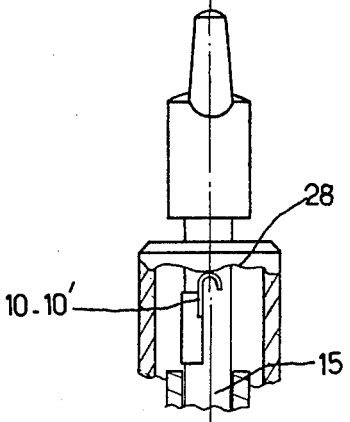
FIG. 7 is a partial axial section according to line F—F of FIG. 6.
Figure 8:
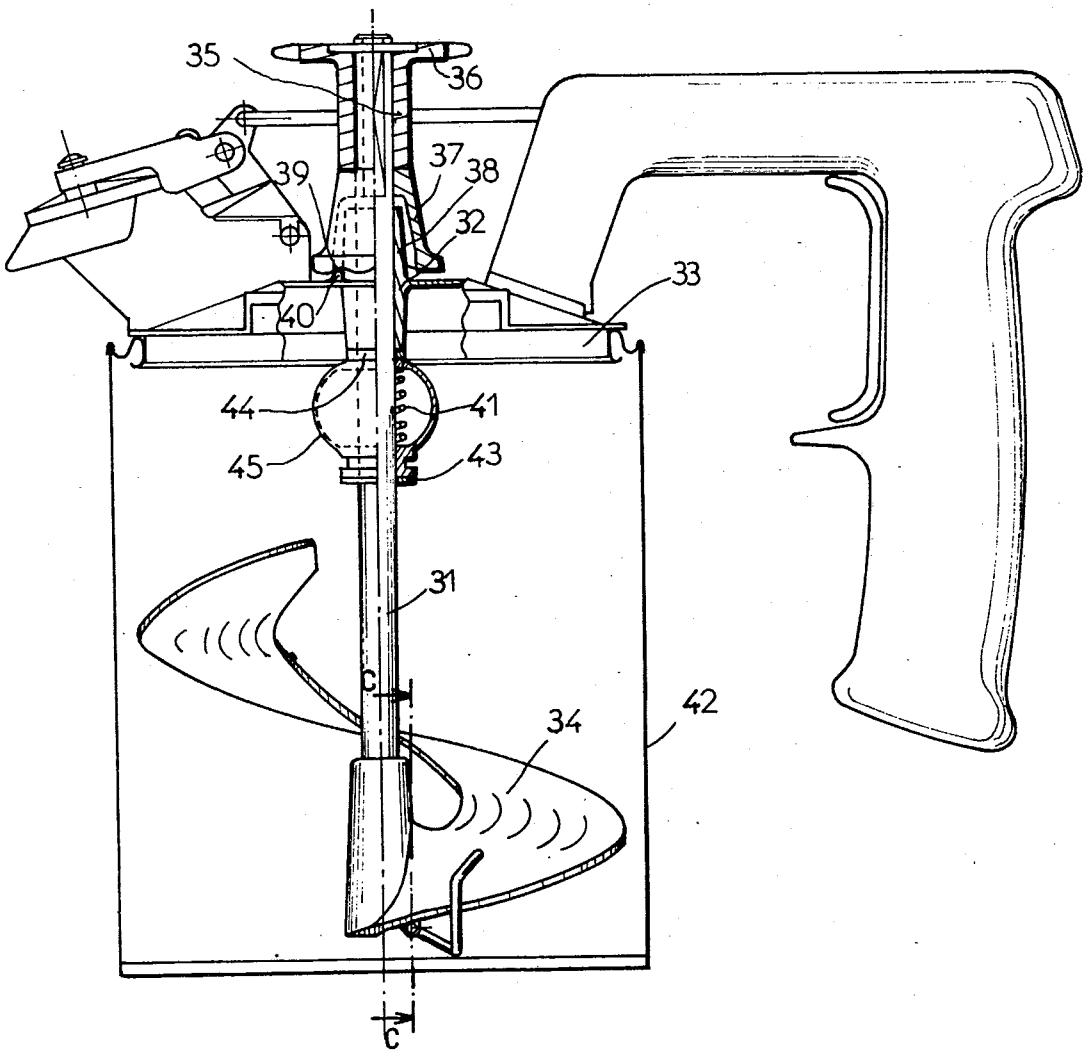
FIG. 8 is an axial section of a mixer according to another embodiment of the invention.
Figure 9:
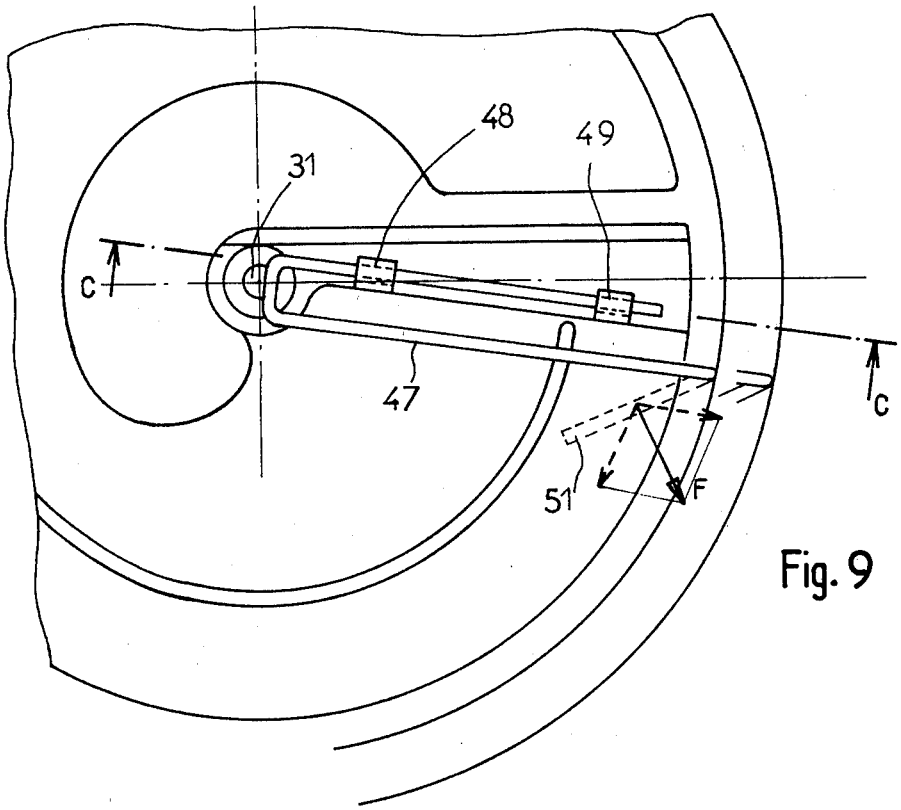
FIG. 9 is a partial view, from underneath, making it possible to illustrate the mounting of the scraping pin on the helical blade.
Figure 10:
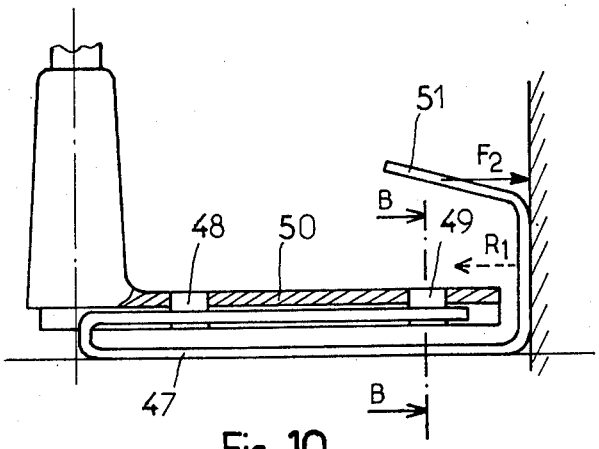
FIG. 10 is a partial section according to line C—C of FIG. 8.
Figure 11:
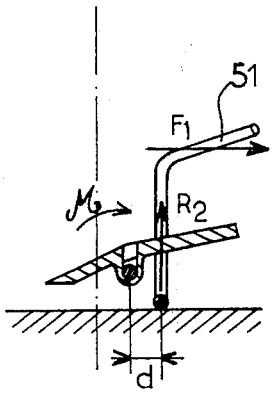
FIG. 11 is a view according to line B—B of FIG. 10.

In the example shown in FIGS. 6 and 7 bearing 20 into which shaft 1 is pivotally mounted extends outwardly on each side of lid 3. Upon the lower end of bearing 20 is attached a tubular element 21 furnished with an internal circular lip 22 for achieving a fluid-tight seal between shaft 1 and lid 3. Furthermore, on the upper face of lid 3 there is additionally connected a tubular coupling sleeve 23 comprising at its upper end a head 24 provided with a coaxial bore 25 through which shaft 1 passes and, at its lower end, a collet 26 provided with bores 27 for the screw-fastening of coupling sleeve 23 on lid 3.

On the lower face 28 of head 24 which presents radial ribs of a sinusoidal appearance, there are carried two stops 10 and 10′ integral with shaft 1 and fabricated in the previously described manner.

The operation of this mixer is appreciably the same as that previously described. However, it is advisable to note that in this embodiment, the assembly producing the axial oscillations of shaft 1 is isolated from the products to be mixed due to the fluid-tight seal achieved by tubular element 21 and lip 22.

As represented in FIGS. 8 to 11, the mixer comprises, first of all, a vertical shaft 31 pivotally mounted at its upper end in a bearing member 32 constructed of the same material as moulded lid 33. At the lower end of shaft 31 there is attached a helical ramp 34 of the type previously described.

Upon the upper end of shaft 31 there is fixedly mounted a tubular casing 35 possessing at its upper end a driving-pinion 36 and whose lower end presents a wide-mouthed shape 37 in bell form in which upper end 38 of the bearing member is introduced. Lower edge 39 of this bell-mouthed element forms a notched crown, for example, of a sinusoidal appearance, which comes to bear upon at least one stop 40 integral with lid 33.

This notched crown 39 is maintained in contact with the stop during the rotation of shaft 31 by means of a helical spring 41 arranged coaxially with shaft 31, on vessel side 42, and which is supported at its lower end upon a self-locking metallic ring 43 and at its upper end upon lid 33 through the intermediary of a washer 44 of an antiadhesive plastic material such as, for example, polytetrafluoroethylene (PTFE).

Helical spring 41 is disposed within a protective housing 45 made of an elastomer which resists the various chemical products commonly found in paints.

The action of housing 45 is twofold: in the one case, it operates an action on the vibrator system and, in the other, it achieves the fluid-tight seal of vertical axis 1.

It will be noted that in the previously described mixer, the vibrator system (notching 39/stop 40) is situated outside lid 33 in order to avoid wear caused by certain types of paints whose pigments are particularly abrasive. Furthermore, bell-shaped element 37 of tubular casing 35 can be made of a different material, for example, of a plastic, which possesses at its lower end said notching 39 (sinusoidal ramp).

Said stops 40 which cause, by their action on notching 39, the axial vibrations of shaft 31 can advantageously consist of two projections shaped out of a piece of processed stamped steel mounted upon lid 33 so as to be easily interchangeable in the event of wear.

In this mixer, the scraping device consists of a pin 47 which slides very freely in two supports 48 and 49 cast with base 50 of helical ramp 34 or, alternatively, by two clips fitting in two rectangular slots formed on said base.

As previously indicated, pin 47 comprises at its upper end an inclined element 51 which receives during rotation, a hydrodynamic pressure $\vec{F}$ caused by the viscosity of the paint. This force $\vec{F}$ can be resolved into a force $\vec{F_2}$ parallel to the axis of supports 48 and 49 in such a way that pin 47 is applied against the lateral wall of vessel 42, causing a reaction $R_1$ and a scraping action of the lateral deposit, and into a force $\vec{F_1}$ perpendicular to one of supports 48 and 49 which causes a moment of rotation M and a reaction $R_2$ upon the bottom of vessel 42, a reaction whose value is greater than force $\vec{F_1}$ given the relatively small distance.

The previously described mixer makes it especially possible to eliminate any drawbacks attendant those illustrated in FIGS. 1 to 7, namely:

- the difficulty of producing scrapers with rings in the shape of a spring;
- a certain fragility, from the fact that it is necessary to use a wire with a rather fine diameter in order that the spring's action will not be too considerable;
- an excessive wearing due to the difficulty in controlling the pressure of the springs on the wall of the vessels, the spring system pressing on the bottom of the container being difficult to replace in case of damage and creating a risk of perforating the vessel which cannot be disregarded.

What is claimed is:

1. A mixer for homogenizing a mixture of products in a vessel having a detachable lid, comprising, a mixer shaft mounting a helical blade, having mounted at its base a scraping device for scraping the inside walls of the vessel comprising a spring exerting an essentially constant pressure on the bottom and side walls of the vessel, said helical blade being rotatively mounted at its top about a substantially vertical axis by a bearing disposed in the lid of the vessel, said mixer further comprising means for vertically moving said helical blade with a vibratory movement having a relatively small vertical amplitude, said moving means comprising a tubular coupling sleeve disposed in said bearing whose lower lip forms a notched crown presenting a sinusoidal cam configuration bearing upon at least one stop integral with said shaft, said at least one stop being maintained in contact with said notched crown by said spring of the scraping device.

2. A mixer according to claim 1, wherein said helical blade is fixed to a tubular coupling sleeve (14) fixedly mounted to the end of said shaft (1), and wherein the lower end of said coupling sleeve is fitted with a spiral upper part of said spring along with the shank of a supporting center-point (15), coaxial with said spring, the head (16) of which abuts against the bottom of the vessel.

3. A mixer for homogenizing a mixture of products in a vessel having a detachable lid, comprising a helical blade rotatively mounted by a vertical shaft mounted, at its upper end, in a bearing disposed in said detachable lid, means for imparting a vertical vibratory motion of relatively small amplitude to said blade, said helical blade being provided at its base with a scraping device which is independent of said means imparting vibratory motion and comprising a pin radially mounted in relation to said shaft on the lower edge of said helical blade so as to slide radially and pivot in relation to the lower edge of said helical blade, said pin comprising an inclined element receiving during rotation a hydrodynamic pressure $\vec{F}$ caused by the viscosity of a mixture to be mixed whose radial component $\vec{F_2}$ in relation to the mixer's axis of rotation causes said pin to slide to apply it against the lateral wall of the vessel, causing a reaction $R_1$ and a scraping effect of material deposited on the wall and whose axial component $F_1$ in relation to said axis causes a moment of rotation M and a reaction $R_2$ on the bottom of the vessel, thereby providing scraping of the bottom of the vessel.

4. A mixer according to claim 3, wherein said pin (47) is mounted in two supports (48,49) integrally formed with the base (50) of the helical ramp (34).

5. A mixer according to claim 3 wherein said pin (47) is provided as two clips fitted in two rectangular slits formed in said base.

6. A mixer according to claim 3, wherein on the upper part of said shaft (31) there is fixedly mounted a tubular casing having at its upper end a driving mechanism (36) whose lower end bears a notched crown (39) which bears on at least one stop (40) integral with the lid, and wherein said notched crown (39) is held in contact with said stop (40) by a helical spring (41) arranged coaxially to the shaft (31) and which is supported at its lower end upon a ring (43) integral with the shaft (51) and at its upper end upon said lid (33).

7. A mixer according to claim 6, wherein said spring (41) is positioned within a protective housing (45) formed of a plastic material resistant to chemical reactions.

8. A mixer according to claim 6, wherein the lower part of said tubular casing (35) possessing said notched crown (39) presents a bell-shaped form housing the upper end of bearing (32), and is formed of a plastic material, and wherein said stops (40) are provided as two projections formed from a detachable metallic piece mounted on said lid (33).

* * * * *